US012746427B1

(12) United States Patent
Moawad

(10) Patent No.: US 12,746,427 B1
(45) Date of Patent: Sep. 29, 2026

(54) MULTI-FUNCTIONAL DEVICE HAVING A COMPRESSION SPRING AND ASSOCIATED METHOD(S)

(71) Applicant: Christopher Moawad, Vero Beach, FL (US)

(72) Inventor: Christopher Moawad, Vero Beach, FL (US)

( * ) Notice: Subject to any disclaimer, the term of this patent is extended or adjusted under 35 U.S.C. 154(b) by 171 days.

(21) Appl. No.: 18/746,986

(22) Filed: Jun. 18, 2024

Related U.S. Application Data

(60) Provisional application No. 63/516,180, filed on Jul. 28, 2023.

(51) Int. Cl.
*A63B 21/02* (2006.01)
*A63B 21/04* (2006.01)

(52) U.S. Cl.
CPC ..... *A63B 21/023* (2013.01); *A63B 21/0442* (2013.01)

(58) Field of Classification Search
CPC ..... A63B 32/4021; A63B 32/4019; A63B 32/4017; A63B 32/4015; A63B 32/4013; A63B 32/4011; A63B 32/0428; A63B 32/00069; A63B 32/00043; A63B 32/05; A63B 32/025; A63B 32/0442; A63B 32/023
See application file for complete search history.

(56) References Cited

U.S. PATENT DOCUMENTS

| | | | | |
|---|---|---|---|---|
| 7,175,575 | B1 * | 2/2007 | Dantolen | A63B 21/05 482/121 |
| 9,114,277 | B2 * | 8/2015 | Goeckel | A63B 23/1281 |
| 2012/0277072 | A1 * | 11/2012 | Coffey | A63B 21/00189 482/122 |
| 2013/0029811 | A1 * | 1/2013 | Lando | A63B 21/05 482/121 |
| 2022/0168612 | A1 * | 6/2022 | Xu | A63B 23/14 |
| 2022/0184444 | A1 * | 6/2022 | An | A63B 21/0004 |

* cited by examiner

*Primary Examiner* — Megan Anderson
*Assistant Examiner* — Jonathan A Dicuia
(74) *Attorney, Agent, or Firm* — Ashkan Najafi

(57) ABSTRACT

A portable muscle training device includes a spring having a proximal end and a distal end, a first appendage-receiving member located adjacent to the proximal end of the spring, a second appendage-receiving member located adjacent to the distal end of the spring, a first coupling detachably affixed to the first appendage-receiving member and further being statically and fixedly engaged with the proximal end of the spring, a second coupling detachably affixed to the second appendage-receiving member and further being statically and fixedly engaged with the distal end of the spring, and a spring-tension adjustment member detachably connected to the second appendage-receiving member and further being adjustably and detachably connected to the second coupling. The operating force of the spring is selectively adjusted when the second coupling is linearly reciprocated along the central longitudinal axis of the spring.

20 Claims, 11 Drawing Sheets

MULTI-FUNCTIONAL DEVICE HAVING A COMPRESSION SPRING AND ASSOCIATED METHOD(S)

CROSS REFERENCE TO RELATED APPLICATIONS

This is a non-provisional patent application that claims priority to and benefit of U.S. provisional patent application No. 63/516,180 filed Jul. 28, 2023, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to exercise devices and, more particularly, to a specially configured muscle training device that has selectively adjustable compression and expansion for use on various muscles of a user body. The muscle training device is easily stored when not in use, does not occupy a great deal of space when in use and provides for exercising all or most of the muscle groups.

Prior Art

Home exercise is becoming increasingly more popular. Home exercise offers the health benefits of regular exercise while recognizing that many people have difficulty in finding sufficient time in their schedule for a full workout at a health club or gymnasium. An exerciser may exercise at home whenever the exerciser's schedule permits. This flexibility in scheduling often allows for a more consistent and thus healthful exercise regime.

Home exercise, however, has its drawbacks. In particular, in order to exercise all or most of the muscle groups, multiple pieces of home exercise equipment may be required. Furthermore, these multiple pieces of equipment may require permanent installation in the exerciser's home.

Permanent or not, many popular pieces of home exercise equipment occupy a great deal of space. This makes the use of this equipment impractical in homes or apartments which do not have the required extra space. Furthermore, non-permanent pieces of equipment are often difficult to disassemble and may require much storage space even when disassembled. A user must then often choose between an exercise device providing a complete exercise regime and a device which fits the exerciser's home space.

Accordingly, a need remains for a muscle training device to overcome at least one of the above-noted shortcomings. The exemplary embodiment(s) satisfy such a need by a specially configured muscle training device that is convenient and easy to use, lightweight yet durable in design, versatile in its applications, and configured to have selectively adjustable compression and expansion for use on various muscles of a user body. The muscle training device is easily stored when not in use, does not occupy a great deal of space when in use and provides for exercising all or most of the muscle groups.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured muscle training device that has selectively adjustable compression and expansion for use on various muscles of a user body. The muscle training device is easily stored when not in use, does not occupy a great deal of space when in use and provides for exercising all or most of the muscle groups. These and other objects, features, and advantages of the non-limiting exemplary embodiment(s) are provided by a portable muscle training device including a spring having a central longitudinal axis, a proximal end, and a distal end axially opposed from the proximal end. The device further includes a first appendage-receiving member being located adjacent to the proximal end of the spring; a second appendage-receiving member being located adjacent to the distal end of the spring; a first coupling being detachably affixed to the first appendage-receiving member and further being statically and fixedly engaged with the proximal end of the spring; a second coupling being detachably affixed to the second appendage-receiving member and further being statically and fixedly engaged with the distal end of the spring; and a spring-tension adjustment member being detachably connected to the second appendage-receiving member and further being adjustably and detachably connected to the second coupling. Advantageously, the operating force of the spring is selectively adjusted when the second coupling is linearly reciprocated parallel to the central longitudinal axis of the spring. Notably, the spring has a spiral and helix shape and the spring-tension adjustment member is concentrically spaced about the spring. Advantageously, the spring is disposed along a single plane and intercalated directly between the first coupling and the second coupling.

In a non-limiting exemplary embodiment, the spring-tension adjustment member is configured to be selectively displaced along a bidirectional rectilinear operating path defined along the central longitudinal axis of the spring.

In a non-limiting exemplary embodiment, the first appendage-receiving member is spaced apart a first distance from the second appendage-receiving member when the spring is at an expanded equilibrium position.

In a non-limiting exemplary embodiment, the first appendage-receiving member is spaced apart a second distance from the second appendage-receiving member when the spring is at a compressed tensioned position; wherein the second distance is less than the first distance.

In a non-limiting exemplary embodiment, the first coupling is threadably coupled to the first appendage-receiving member.

In a non-limiting exemplary embodiment, the second coupling is abutted at an end-to-end configuration with the second appendage-receiving member.

In a non-limiting exemplary embodiment, the first appendage-receiving member has a first threaded protrusion extended outwardly therefrom and being aligned along the central longitudinal axis.

In a non-limiting exemplary embodiment, the second appendage-receiving member has a second threaded protrusion extended outwardly therefrom and being aligned along the central longitudinal axis.

In a non-limiting exemplary embodiment, the spring-tension adjustment member is concentrically spaced about the distal end of the spring and directly connected to the second coupling and the second threaded protrusion.

In a non-limiting exemplary embodiment, each of the first appendage-receiving member and the second appendage-receiving member includes: a pair of hingedly pivotal arcuate clamps configured to receive one of forearms and thighs of the user, respectively.

In a non-limiting exemplary embodiment, each of the first appendage-receiving member and the second appendage-receiving member includes a pair of hingedly pivotal arcuate clamps configured to receive both a forearm of the user and a bicep of the user, respectively. Advantageously, the second appendage-receiving member includes a support block intercalated between one of the pair of hingedly pivotal arcuate clamps and the second threaded protrusion.

In a non-limiting exemplary embodiment, the second appendage-receiving member includes a pair of hingedly pivotal arcuate clamps configured to receive a thigh of the user, and a support block intercalated between the pair of hingedly pivotal arcuate clamps and the second threaded protrusion. Advantageously, the first appendage-receiving member includes a foot-receiving socket directly affixed to the first threaded protrusion and configured to receive a foot of the user.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter, and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
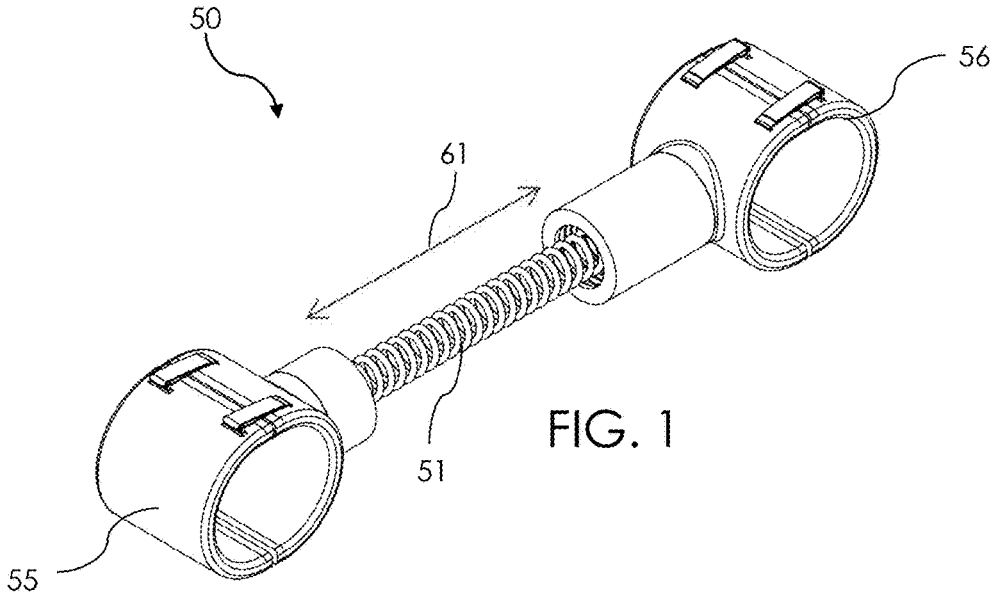
FIG. 1 is a perspective view of a multi-functional device having a succinctly and precisely adjustable compression spring (thigh muscle exercise device), in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational and are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

Figure 2:
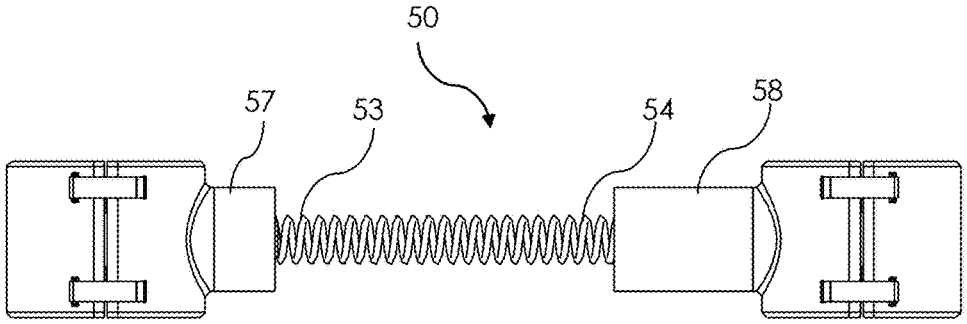
FIG. 2 is a top plan view of the thigh muscle exercise device.
Figure 3:
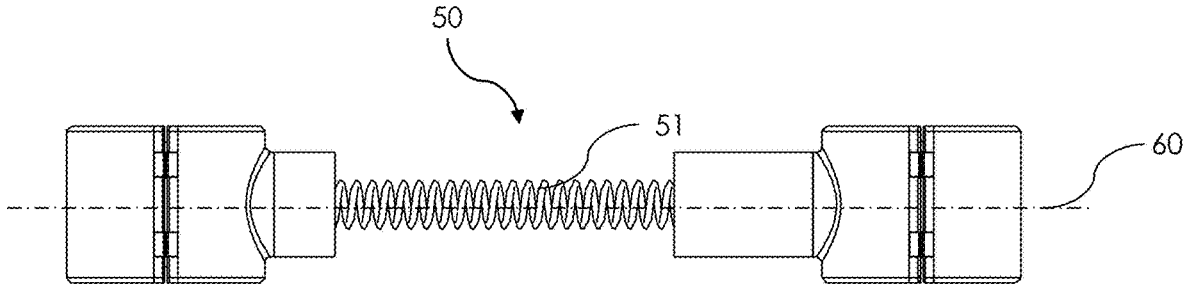
FIG. 3 is a bottom plan view of the thigh muscle exercise device.
Figure 4:
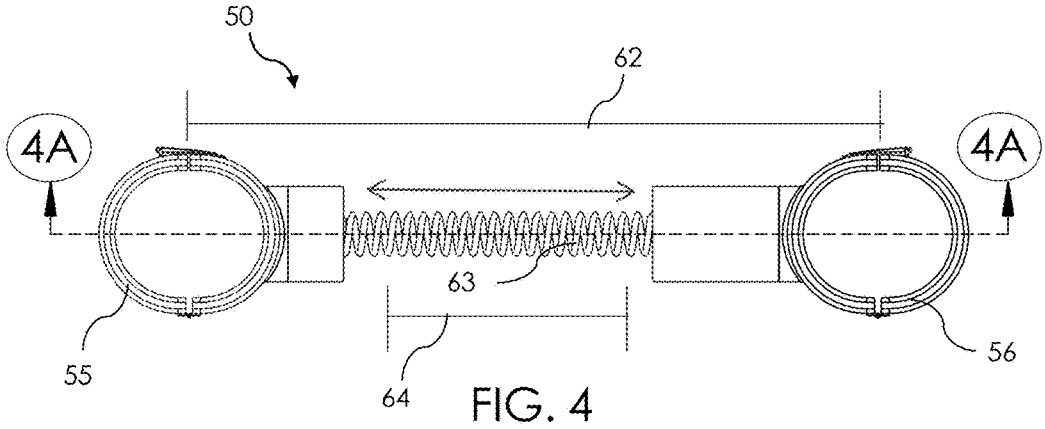
FIG. 4 is a side elevational view of the thigh muscle exercise device.
Figure 4A:
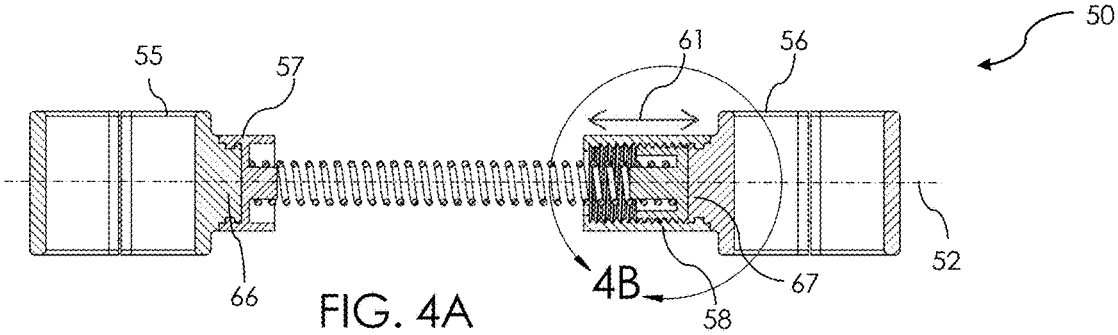
FIG. 4A is a cross-sectional view taken along line 4A-4A in FIG. 4.
Figure 4B:
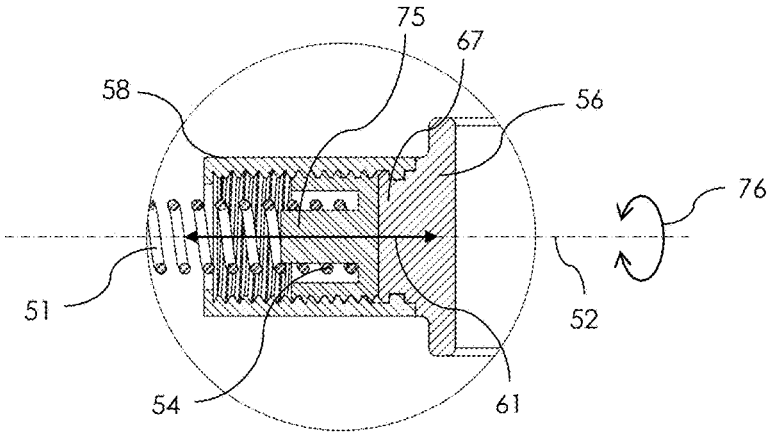
FIG. 4B is an enlarged view of section 4B taken in FIG. 4A.
Figure 5:
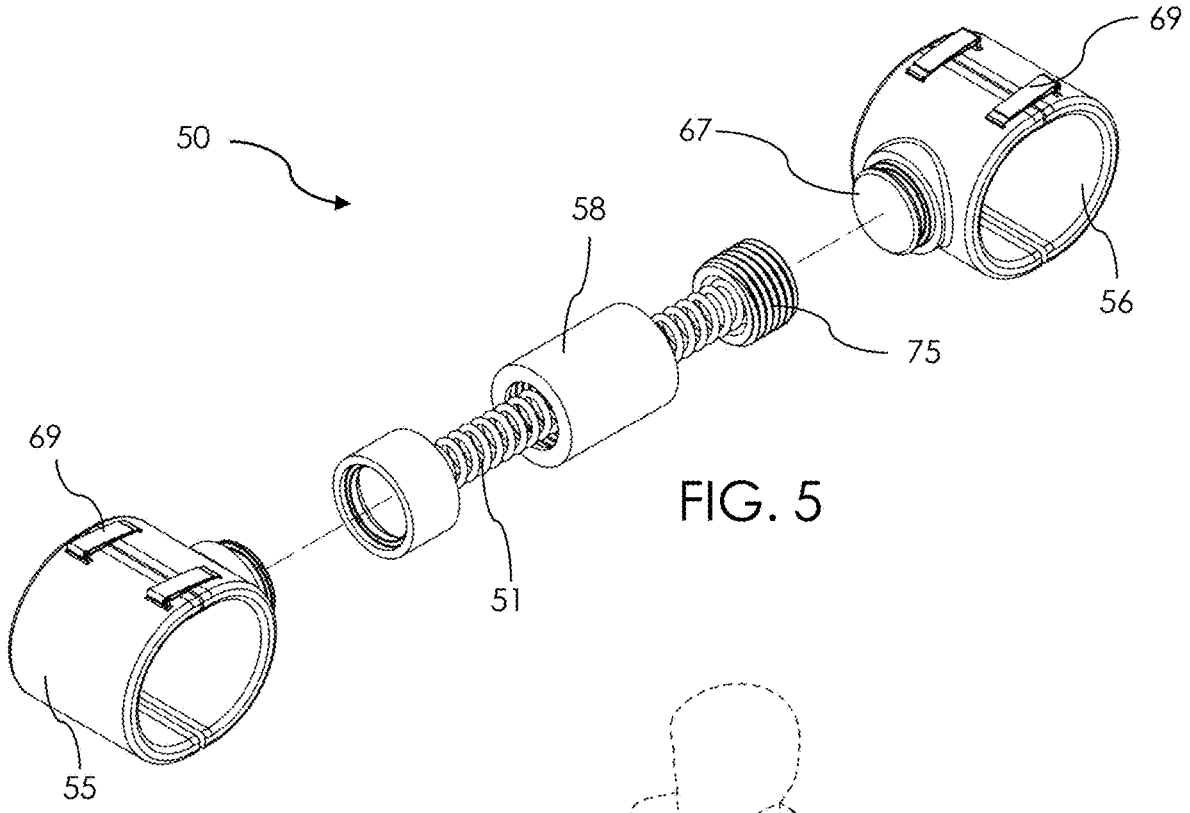
FIG. 5 is an exploded view of the thigh muscle exercise device.
Figure 6:
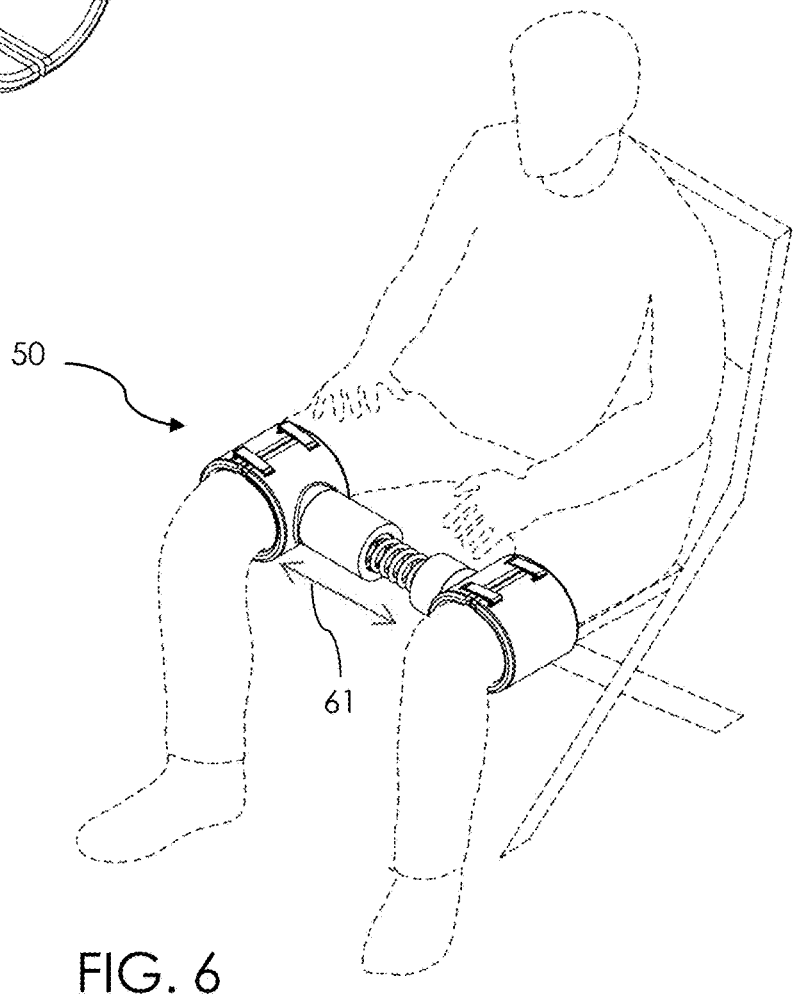
FIG. 6 is an environmental view showing use of the thigh muscle exercise device.
Figure 7:
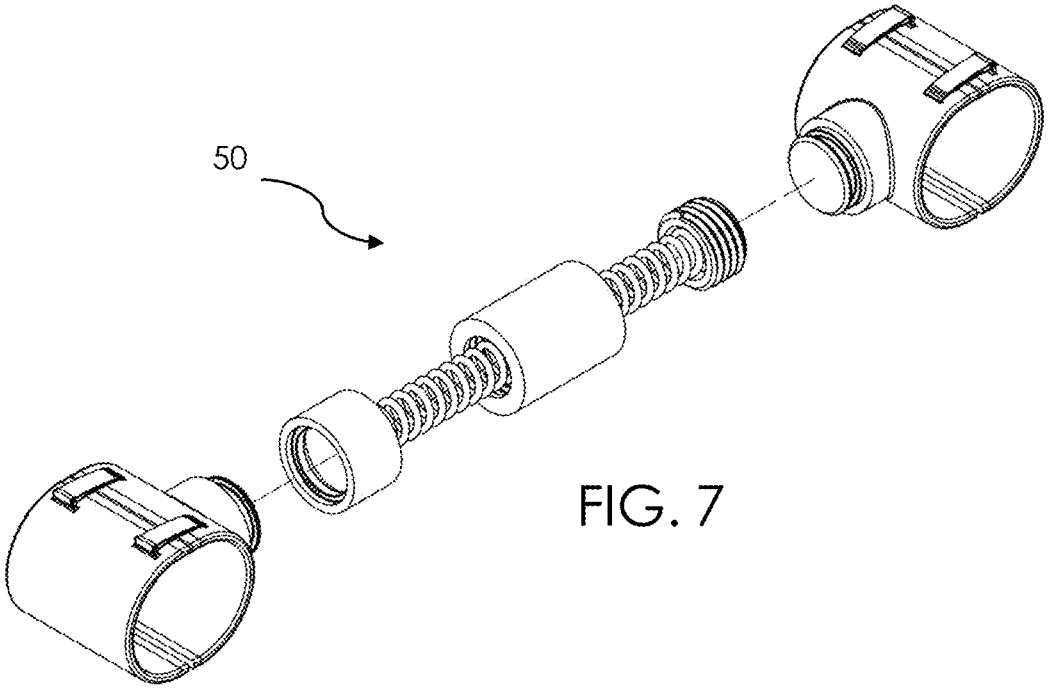
FIG. 7 is an exploded view of a multi-functional device having a succinctly and precisely adjustable compression spring (forearm muscle exercise device), in accordance with a non-limiting exemplary embodiment of the present disclosure.
Figure 8:
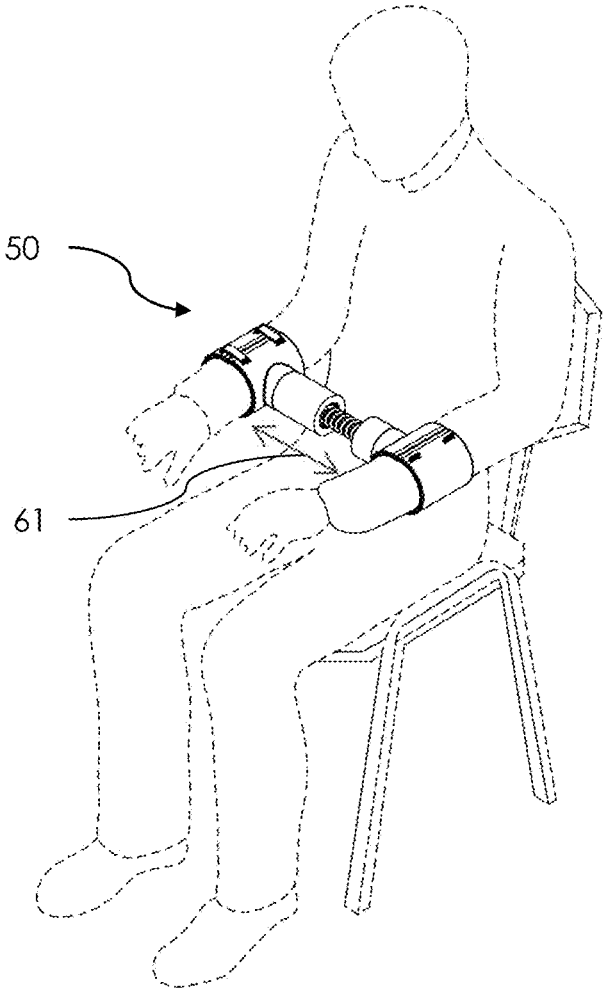
FIG. 8 is an environmental view showing use of the forearm muscle exercise device.
Figure 9:
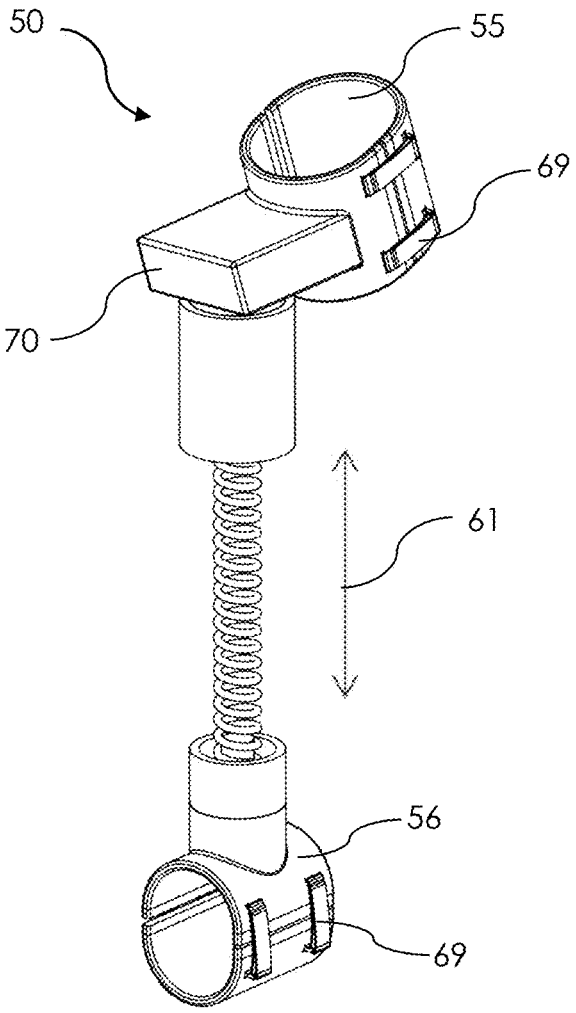
FIG. 9 is a perspective view of a multi-functional device having a succinctly and precisely adjustable compression spring (bicep muscle exercise device), in accordance with a non-limiting exemplary embodiment of the present disclosure.
Figure 10:
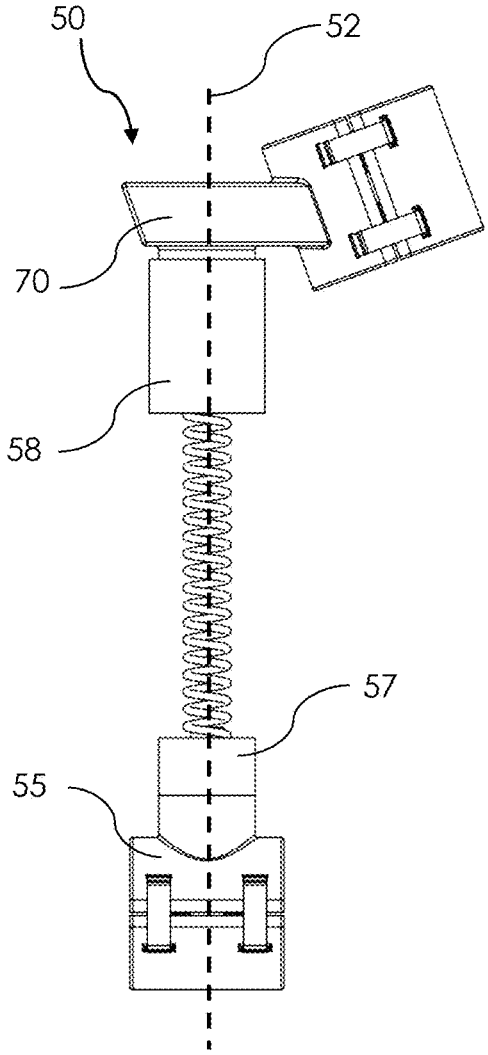
FIG. 10 is a left side elevational view of the bicep muscle exercise device.
Figure 11:
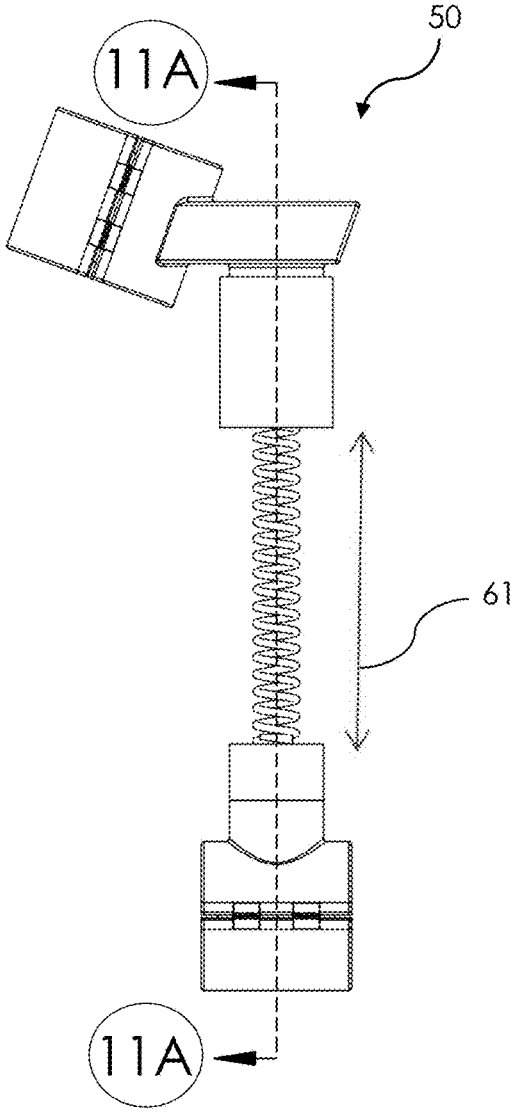
FIG. 11 is a right side elevational view of the bicep muscle exercise device.
Figure 11A:
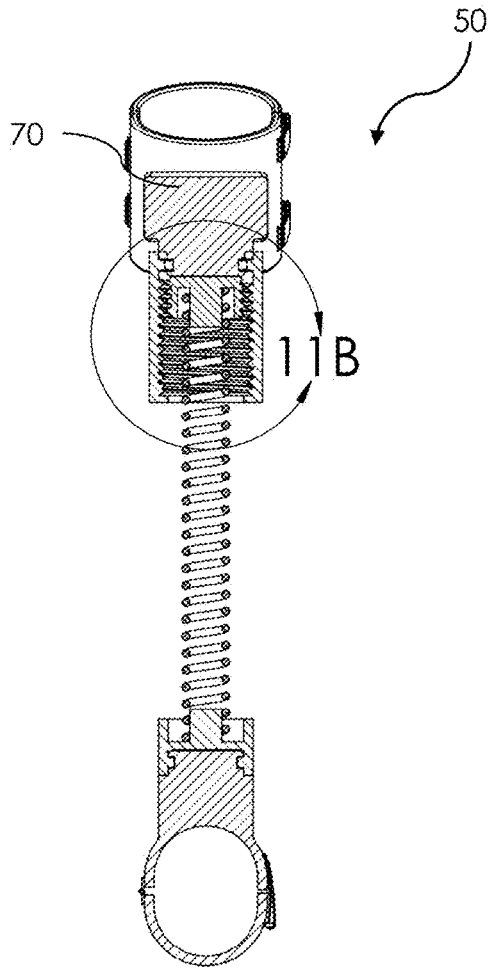
FIG. 11A is a cross-sectional view taken along line 11A-11A in FIG. 11.
Figure 11B:
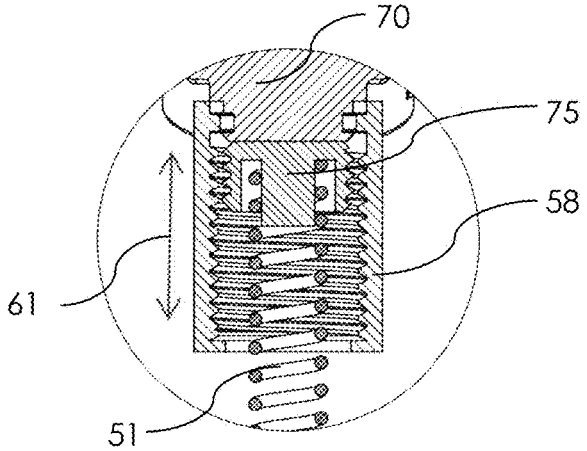
FIG. 11B is an enlarged view of section 11B taken in FIG. 11A.
Figure 12:
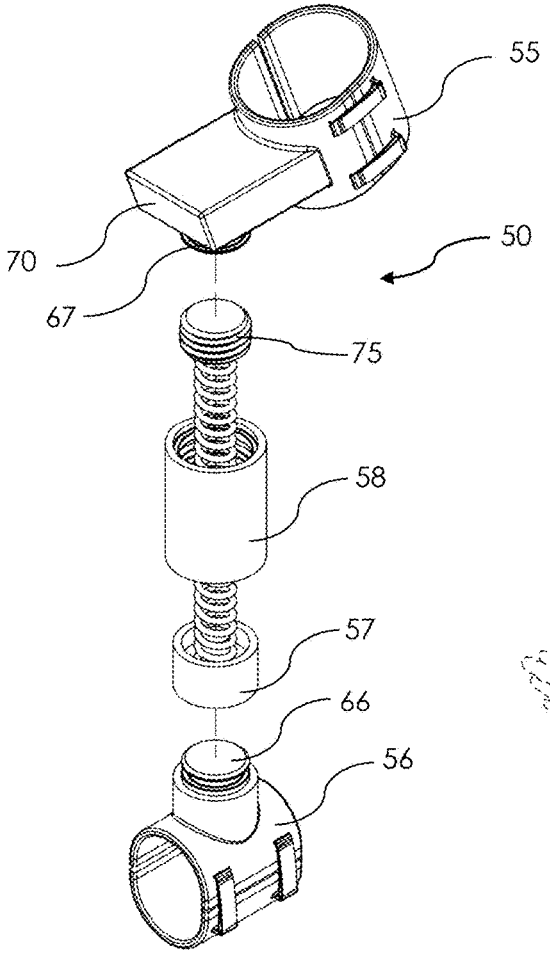
FIG. 12 is an exploded view of the bicep muscle exercise device.
Figure 13:
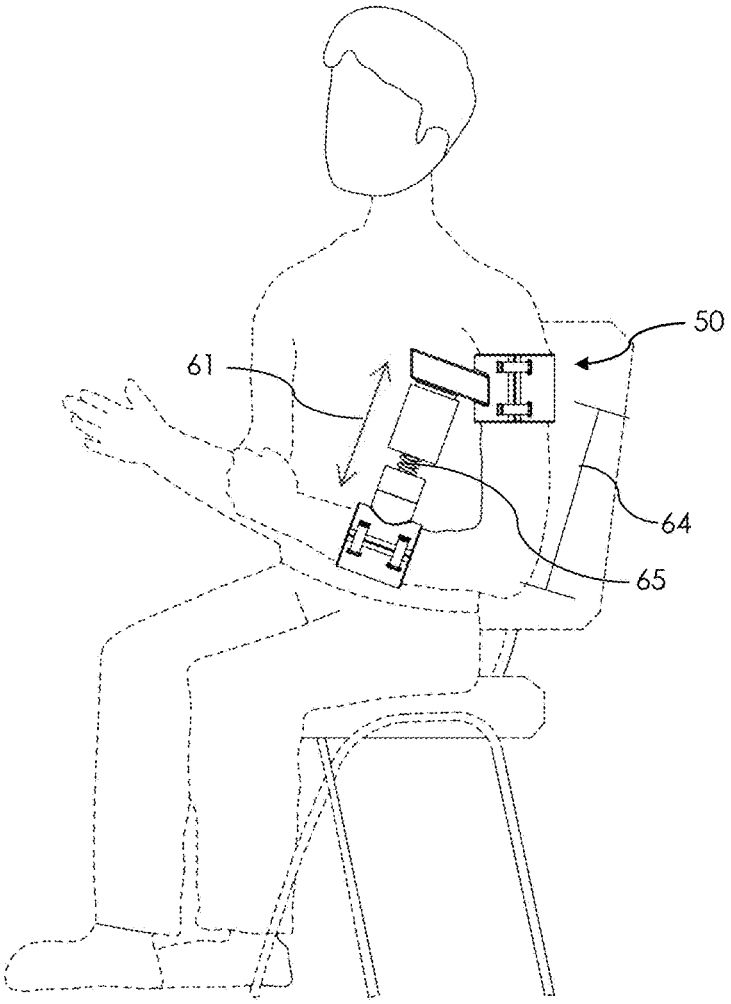
FIG. 13 is an environmental view showing use of the bicep muscle exercise device.
Figure 14:
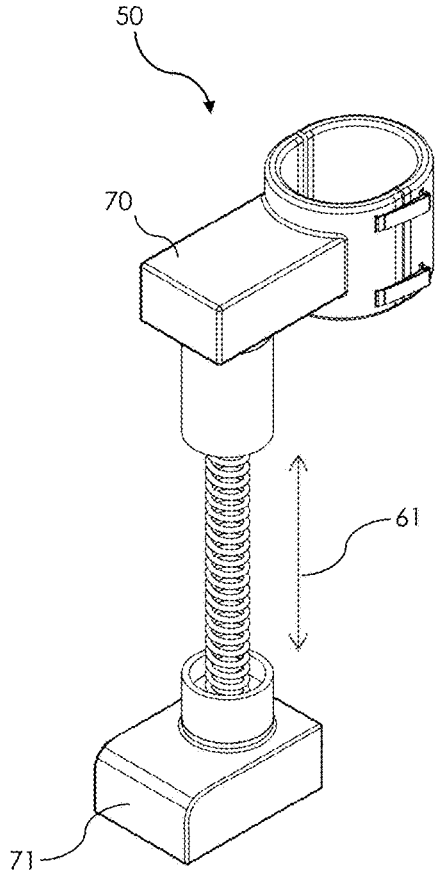
FIG. 14 is a perspective view of a multi-functional device having a succinctly and precisely adjustable compression spring (calf muscle exercise device), in accordance with a non-limiting exemplary embodiment of the present disclosure.
Figure 15:
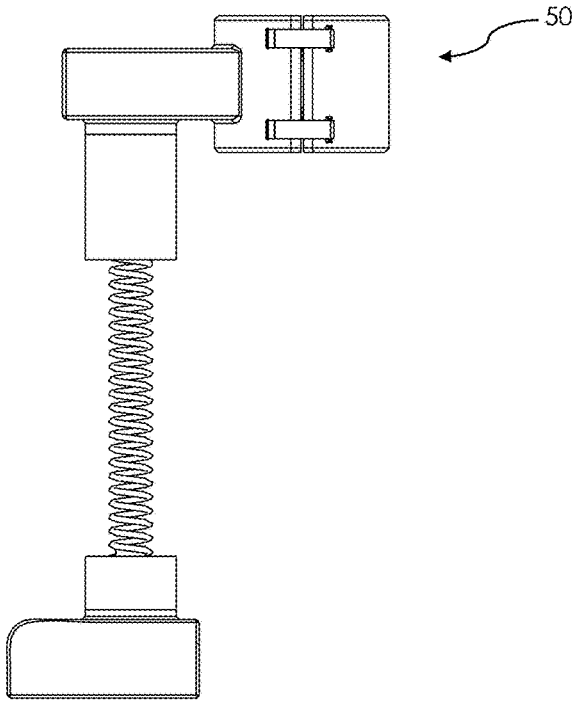
FIG. 15 is a left side elevational view of the calf muscle exercise device.
Figure 16:
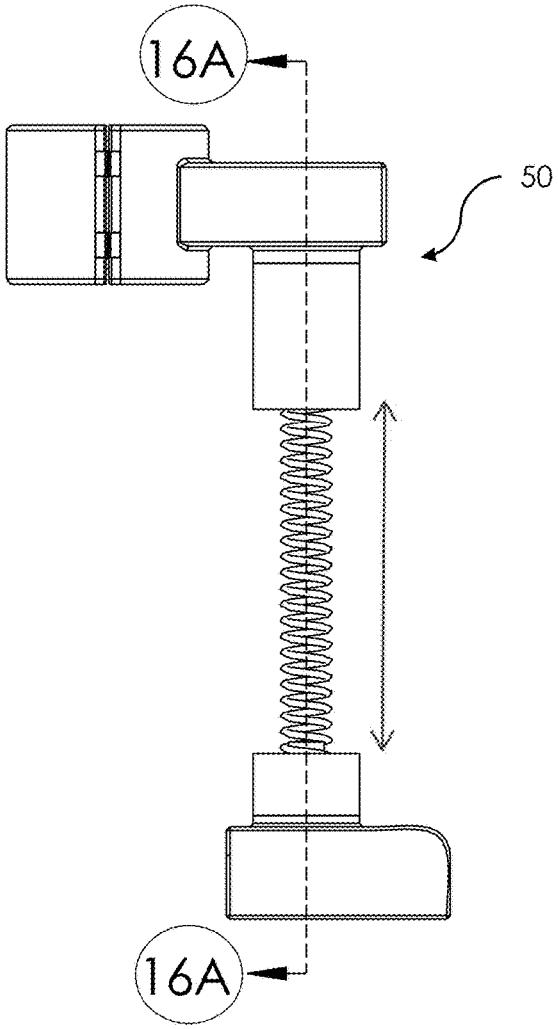
FIG. 16 is a right side elevational view of the calf muscle exercise device.
Figure 16A:
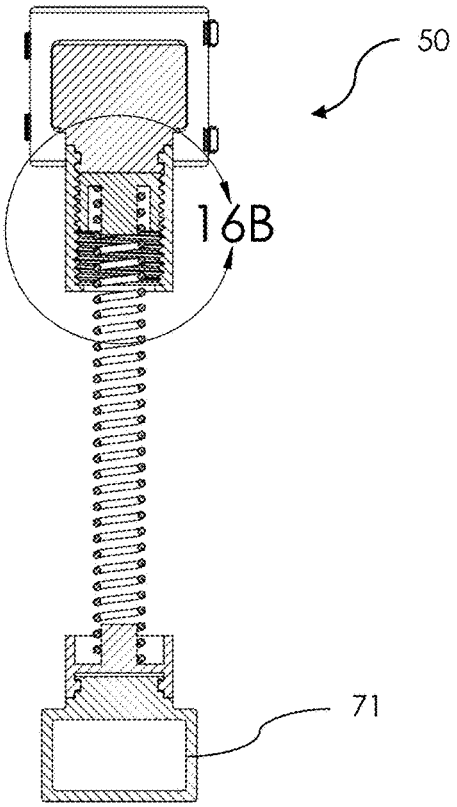
FIG. 16A is a cross-sectional view taken along line 16A-16A in FIG. 16.
Figure 16B:
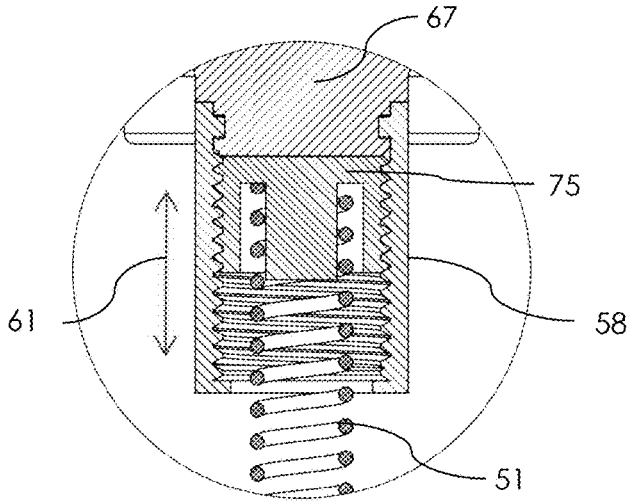
FIG. 16B is an enlarged view of section 16B taken in FIG. 16A.
Figure 17:
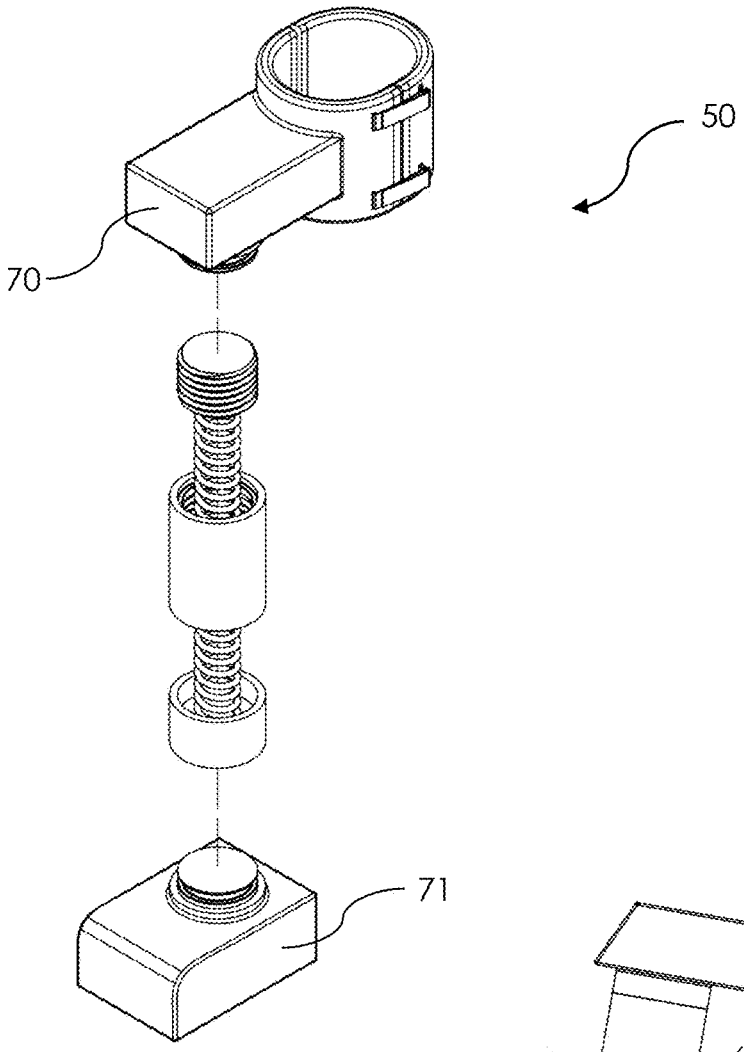
FIG. 17 is an exploded view of the calf muscle exercise device.
Figure 18:
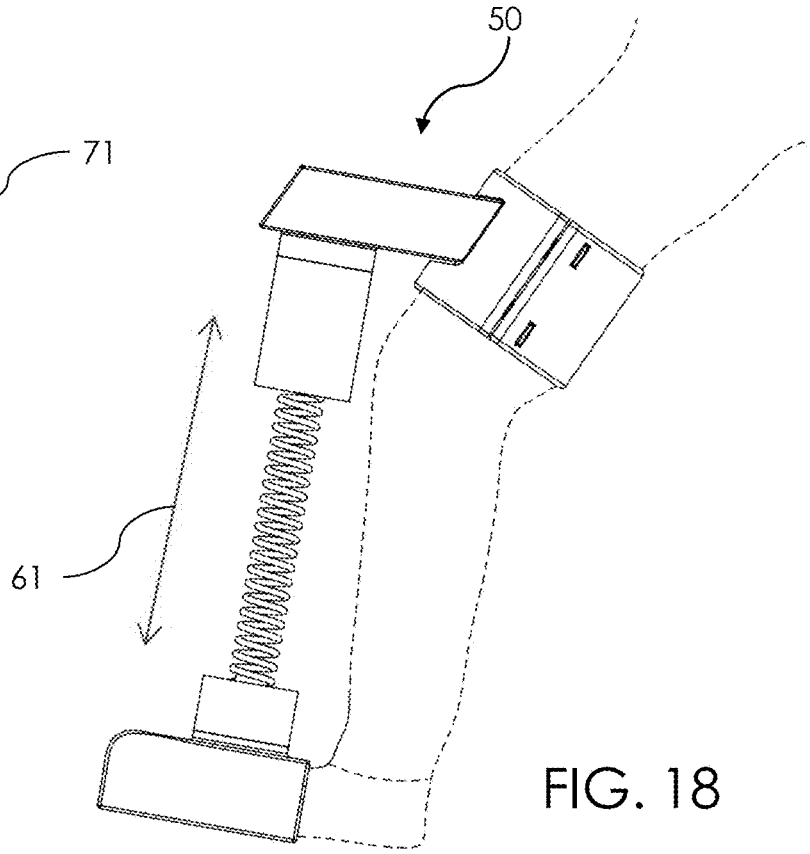
FIG. 18 is an environmental view showing use of the calf muscle exercise device.
Figure 21A:
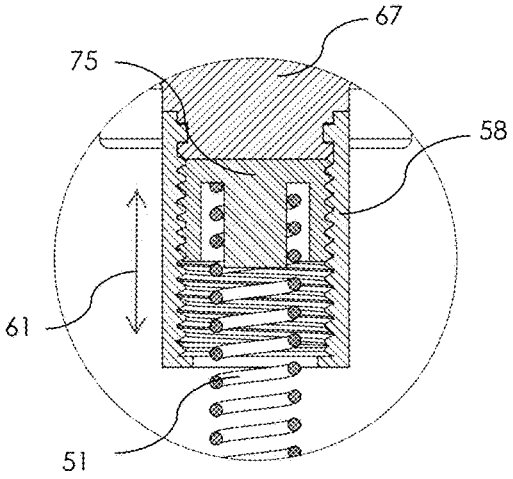
FIG. 21A is an enlarged cross-sectional view taken along line 21A-21A in FIG. 21.
Figure 21:
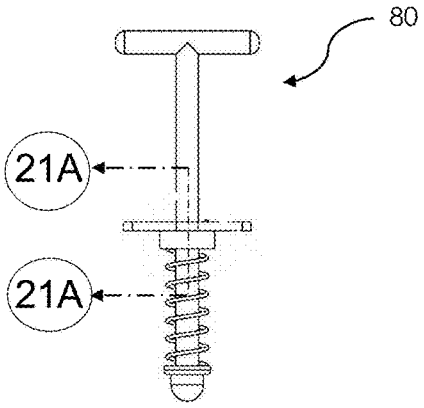
FIG. 21 is a front elevational view of the knee muscle exercise device.
Figure 20:
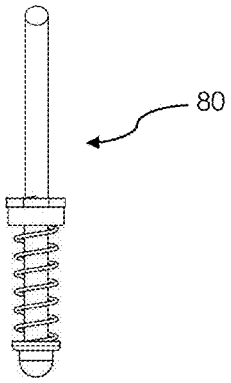
FIG. 20 is a side elevational view of the knee muscle exercise device.
Figure 19:
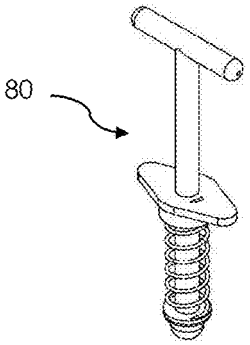
FIG. 19 is a perspective view of a multi-functional device having a succinctly and precisely adjustable compression spring (pogo stick exercise device), in accordance with a non-limiting exemplary embodiment of the present disclosure.

The non-limiting exemplary embodiment(s) is/are referred to generally in FIGS. 1-21A and is/are intended to provide a specially configured muscle training device 50 that has selectively adjustable compression and expansion for use on various muscles of a user body. The muscle training device 50 is easily stored when not in use, does not occupy a great deal of space when in use and provides for exercising all or most of the muscle groups. It should be understood that the exemplary embodiment(s) may be used to train various muscles of a user body and should not be limited to any particular muscle described herein.

Referring to FIGS. 1-21A in general, in a non-limiting exemplary embodiment(s), the multi-functional device may be portable muscle training device 50 or a portable pogo stick 80. The portable muscle training device 50 includes a spring 51 having a central longitudinal axis 52, a proximal end 53, and a distal end 54 axially opposed from the proximal end 53. The device 50 further includes a first appendage-receiving member 55 being located adjacent to the proximal end 53 of the spring 51; a second appendage-receiving member 56 being located adjacent to the distal end 54 of the spring 51; a first coupling 57 being detachably affixed to the first appendage-receiving member 55 and further being statically and fixedly engaged with the proximal end 53 of the spring 51; a second coupling 58 being detachably affixed to the second appendage-receiving member 56 and further being statically and fixedly engaged with the distal end 54 of the spring 51; and a spring-tension adjustment member 75 being detachably connected to the second appendage-receiving member 56 and further being adjustably and detachably connected to the second coupling 58. Advantageously, an operating force of the spring 51 is selectively adjusted when the second coupling 58 is linearly reciprocated parallel to the central longitudinal axis 52 of the spring 51 by rotating 76 the second coupling 58 in clockwise and counter clockwise directions, respectively, about the spring-tension member 75. In particular, as the second coupling 58 is rotated about the spring-tension member 75, a longitudinal length of the spring 51 is expanded and contracted. Notably, the spring 51 has a spiral and helix shape and the spring-tension adjustment member 75 is concentrically spaced about the spring 51 and statically affixed thereto. Advantageously, the spring 51 is disposed along a single plane 60 and intercalated directly between the first coupling 57 and the second coupling 58. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the spring-tension adjustment member 75 is configured to be selectively displaced along a bidirectional rectilinear operating path 61 defined along the central longitudinal axis 52 of the spring 51. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the first appendage-receiving member 55 is spaced apart a first distance 62 from the second appendage-receiving member 56 when the spring 51 is at an expanded equilibrium position 63. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the first appendage-receiving member 55 is spaced apart a second distance 64 from the second appendage-receiving member 56 when the spring 51 is at a compressed tensioned position 65, wherein the second distance 64 is less than the first distance 62. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the first coupling 57 is threadably coupled to the first appendage-receiving member 55. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the second coupling 58 is threadably abutted at an end-to-end configuration with the second appendage-receiving member 56. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the first appendage-receiving member 55 has a first threaded protrusion 66 extended outwardly therefrom and being aligned along the central longitudinal axis 52. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the second appendage-receiving member 56 has a second threaded protrusion 67 extended outwardly therefrom and being aligned along the central longitudinal axis 52. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the spring-tension adjustment member 75 is concentrically spaced about the distal end 54 of the spring 51 and directly connected to the second coupling 58 and the second threaded protrusion 67. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, each of the first appendage-receiving member 55 and the second appendage-receiving member 56 includes: a pair of hingedly pivotal arcuate clamps 69 configured to receive one of forearms and thighs of the user, respectively. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, each of the first appendage-receiving member 55 and the second appendage-receiving member 56 includes a pair of hingedly pivotal arcuate clamps 69 configured to receive both a forearm of the user and a bicep of the user, respectively. Advantageously, the second appendage-receiving member 56 includes a support block 70 intercalated between one of the pair of hingedly pivotal arcuate clamps 69 and the second threaded protrusion 67. Such a structural configuration yields the new, useful, and unpredicted result of succinctly, precisely, and selectively adjusting compression and/or expansion forces of the spring 51 with one hand and without having to completely disassemble the device 50.

In a non-limiting exemplary embodiment, the second appendage-receiving member 56 includes a pair of hingedly pivotal arcuate clamps 69 configured to receive a thigh of the user, and a support block 70 intercalated between the pair of hingedly pivotal arcuate clamps 69 and the second threaded protrusion 67. Advantageously, the first appendage-receiving member 55 includes a foot-receiving socket 71 directly affixed to the first threaded protrusion 66 and configured to receive a foot of the user. Such a structural configuration yields the new, useful, and unpredicted result of succinctly, precisely, and selectively adjusting compression and/or expansion forces of the spring 51 with one hand and without having to completely disassemble the device 50.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A portable muscle training device comprising:

a spring having a central longitudinal axis, a proximal end, and a distal end axially opposed from said proximal end;

a first appendage-receiving member being located adjacent to said proximal end of said spring;

a second appendage-receiving member being located adjacent to said distal end of said spring;

a first coupling being detachably affixed to said first appendage-receiving member and further being statically and fixedly engaged with said proximal end of said spring;

a second coupling being detachably affixed to said second appendage-receiving member and further being statically and fixedly engaged with said distal end of said spring; and a spring-tension adjustment member being detachably connected to said second appendage-receiving member and further being adjustably and detachably connected to said second coupling;

wherein an operating force of said spring is selectively adjusted when said second coupling is linearly reciprocated along the central longitudinal axis of said spring;

wherein said spring has a spiral and helix shape;

wherein said spring-tension adjustment member is concentrically spaced about said spring.

2. The muscle training device of claim 1, wherein said spring-tension adjustment member is configured to be selectively displaced along a bidirectional rectilinear operating path defined along the central longitudinal axis of said spring.

3. The muscle training device of claim 2, wherein said first appendage-receiving member is spaced apart a first distance from said second appendage-receiving member when said spring is at an expanded equilibrium position.

4. The muscle training device of claim 3, wherein said first appendage-receiving member is spaced apart a second distance from said second appendage-receiving member when said spring is at a compressed tensioned position; wherein said second distance is less than said first distance.

5. The muscle training device of claim 4, wherein said first coupling is threadably coupled to said first appendage-receiving member.

6. The muscle training device of claim 5, wherein said second coupling is abutted at an end-to-end configuration with said second appendage-receiving member.

7. The muscle training device of claim 6, wherein said first appendage-receiving member has a first threaded protrusion extended outwardly therefrom and being aligned along the central longitudinal axis.

8. The muscle training device of claim 7, wherein said second appendage-receiving member has a second threaded protrusion extended outwardly therefrom and being aligned along the central longitudinal axis.

9. The muscle training device of claim 8, wherein said spring-tension adjustment member is concentrically spaced about said distal end of said spring and directly connected to said second coupling and said second threaded protrusion.

10. The muscle training device of claim 9, wherein each of said first appendage-receiving member and said second appendage-receiving member comprises: a pair of hingedly pivotal arcuate clamps configured to receive one of forearms and thighs of the user, respectively.

11. The muscle training device of claim 8, wherein each of said first appendage-receiving member and said second appendage-receiving member comprises: a pair of hingedly pivotal arcuate clamps configured to receive both a forearm of the user and a bicep of the user, respectively; wherein said second appendage-receiving member includes a support block intercalated between one of said pair of hingedly pivotal arcuate clamps and said second threaded protrusion.

12. The muscle training device of claim 8, wherein said second appendage-receiving member comprises:

a pair of hingedly pivotal arcuate clamps configured to receive a thigh of the user, and a support block intercalated between said pair of hingedly pivotal arcuate clamps and said second threaded protrusion;

wherein said first appendage-receiving member includes a foot-receiving socket directly affixed to said first threaded protrusion and configured to receive a foot of the user.

13. A portable muscle training device comprising:

a spring having a central longitudinal axis, a proximal end, and a distal end axially opposed from said proximal end;

a first appendage-receiving member being located adjacent to said proximal end of said spring;

a second appendage-receiving member being located adjacent to said distal end of said spring;

a first coupling being detachably affixed to said first appendage-receiving member and further being statically and fixedly engaged with said proximal end of said spring;

a second coupling being detachably affixed to said second appendage-receiving member and further being statically and fixedly engaged with said distal end of said spring; and a spring-tension adjustment member being detachably connected to said second appendage-receiving member and further being adjustably and detachably connected to said second coupling;

wherein an operating force of said spring is selectively adjusted when said second coupling is linearly reciprocated along the central longitudinal axis of said spring;

wherein said spring has a spiral and helix shape;

wherein said spring-tension adjustment member is concentrically spaced about said spring;

wherein said spring is disposed along a single plane and intercalated directly between said first coupling and said second coupling.

14. The muscle training device of claim 13, wherein said spring-tension adjustment member is configured to be selectively displaced along a bidirectional rectilinear operating path defined along the central longitudinal axis of said spring.

15. The muscle training device of claim 14, wherein said first appendage-receiving member is spaced apart a first distance from said second appendage-receiving member when said spring is at an expanded equilibrium position.

16. The muscle training device of claim 15, wherein said first appendage-receiving member is spaced apart a second distance from said second appendage-receiving member when said spring is at a compressed tensioned position; wherein said second distance is less than said first distance.

17. The muscle training device of claim 16, wherein said first coupling is threadably coupled to said first appendage-receiving member.

18. The muscle training device of claim 17, wherein said second coupling is abutted at an end-to-end configuration with said second appendage-receiving member.

19. The muscle training device of claim 18, wherein said first appendage-receiving member has a first threaded protrusion extended outwardly therefrom and being aligned along the central longitudinal axis.

20. The muscle training device of claim 19, wherein said second appendage-receiving member has a second threaded protrusion extended outwardly therefrom and being aligned along the central longitudinal axis.

* * * * *